United States Patent [19]

Sharp

[11] Patent Number: 4,807,675

[45] Date of Patent: Feb. 28, 1989

[54] OVERFILL ASSEMBLY WITH REMOVABLE LID

[76] Inventor: Bruce R. Sharp, 4090 Rosehill Ave., Cincinnati, Ohio 45229

[21] Appl. No.: 50,696

[22] Filed: May 18, 1987

Related U.S. Application Data

[63] Continuation-in-part of Ser. No. 858,656, May 1, 1986, abandoned.

[51] Int. Cl.[4] ..... F16L 5/00; B65B 3/06

[52] U.S. Cl. ..... 141/86; 404/25; 137/547; 138/89; 141/98; 52/20; 220/315

[58] Field of Search ..... 141/86, 88, 98, 311 A; 222/108; 137/312, 314, 356, 363, 364, 368, 369, 370, 371, 546, 547; 52/19, 20; 404/25, 26; 220/18, 315, 80 F, 217, 314, 220, 281, 324, 221, 85 P, 855; 4/288; 138/89

[56] References Cited

U.S. PATENT DOCUMENTS

| | | | |
|---|---|---|---|
| 1,139,188 | 5/1915 | Kane | 404/25 X |
| 2,235,308 | 3/1941 | Banker | 189/89 X |
| 3,633,219 | 1/1972 | Byrd | 137/363 |
| 3,670,920 | 6/1972 | Rohrlick | 220/315 |
| 3,722,549 | 3/1973 | Wilson et al. | 138/89 |
| 3,724,495 | 4/1973 | Hartley | 137/547 |
| 3,871,401 | 3/1975 | Lyons | 141/86 X |
| 4,098,427 | 7/1978 | Duckworth, Jr. | 138/89 |
| 4,127,215 | 11/1978 | Morrison | 220/314 |
| 4,204,564 | 5/1980 | Balfour | 141/311 A |
| 4,278,115 | 7/1981 | Briles et al. | 141/86 |
| 4,351,446 | 9/1982 | Madden | 138/89 X |
| 4,457,349 | 7/1984 | Vazin | 141/86 |
| 4,501,377 | 2/1985 | Palmer, III | 220/314 |
| 4,593,714 | 6/1986 | Madden | 141/86 |
| 4,615,362 | 10/1986 | Hartman et al. | 141/86 |
| 4,655,361 | 4/1987 | Clover et al. | 220/85 F |
| 4,659,251 | 4/1987 | Petter et al. | 141/86 X |
| 4,696,330 | 9/1987 | Raudman et al. | 141/86 |
| 4,706,718 | 11/1987 | Milo | 141/86 |

FOREIGN PATENT DOCUMENTS

| | | | |
|---|---|---|---|
| 168408 | 9/1931 | Fed. Rep. of Germany | 220/314 |

*Primary Examiner*—Henry J. Recla
*Assistant Examiner*—Ernest G. Cusick
*Attorney, Agent, or Firm*—Charles R. Wilson

[57] ABSTRACT

An overfill assembly for use with storage tanks, especially underground gasoline storage tanks. The overfill assembly comprises a dump tank with a fill pipe mounted therein. The fill pipe extends through the dump tank's bottom and is in communication with the storage tank. A removable center-point compression sealing lid member for the dump tank allows for ready access to the fill pipe. A valve mechanism in the dump tank allows for controlled emptying of spilled liquid in the dump tank to the storage tank.

18 Claims, 8 Drawing Sheets

OVERFILL ASSEMBLY WITH REMOVABLE LID

This application is a continuation-in-part of "Overfill Tanks For Use On Storage Tanks", Ser. No. 06/858,656, filed May 1, 1986, now abandoned.

This invention relates to overfill tanks. More particularly, this invention relates to overfill tanks for use with underground storage tanks.

BACKGROUND OF THE INVENTION

Present filling methods for underground storage tanks involve parking a tank truck adjacent to a fill pipe of the storage tank, and then attaching a flexible delivery hose leading from the tank truck's control panel to a liquid tight fitting at an accessible upper end of the underground storage tank's fill pipe. A liquid, such as gasoline is pumped into the storage tank until the operator ceases the filling operation or the tank fills completely and an automatic shut-off valve shuts off the pump system. There is always the possibility that a substantial amount of gasoline will be trapped in the delivery hose, up to about thirty-five gallons. Without special precautions being taken this trapped gasoline may be carelessly spilled onto the ground with the consequent possibility of earth and water contamination.

It is apparent that container means of some type must be provided for handling of the liquids trapped in a delivery hose. Various overflow tank and auxiliary holding tank systems are known in the prior art. Examples of these are disclosed in U.S. Pat. Nos. 3,983,913; 4,204,564; and 4,501,305. One drawback all the disclosed systems have is the inflexibility and consequent difficulty of the tank truck operator being able to connect the delivery hose to the fill pipe's attachment fitting. Most delivery hoses are bulky; additionally, known overflow systems have a hinged lid which extends upward when opened. The result is that a large surface opening must be provided for access to the hinged lid and the operator must position his tank so that the hinged lid does not block entry of the delivery hose to the fill pipe's fitting.

The development of the present invention provides ready access to a fill pipe for an underground storage tank. The development also provides a means for retaining gasoline that a delivery hose contains after its fill function has been completed. The excess trapped gasoline is emptied into a dump truck, which is either automatically drained or manually drained into the storage tank as gasoline is pumped from the storage tank in normal service station operation.

SUMMARY OF THE INVENTION

An overfill assembly for use on underground storage tanks comprises a dump tank, a fill pipe, a valve mechanism and a removable lid member. The lid member has a removable center-point compression sealing cover which allows ready access to the dump tank's interior. The valve mechanism either manually or automatically allows gasoline within the dump tank to drain into the storage tank as space permits.

DETAILED DESCRIPTION OF THE PREFERRED EMBODIMENT

Figure 1:
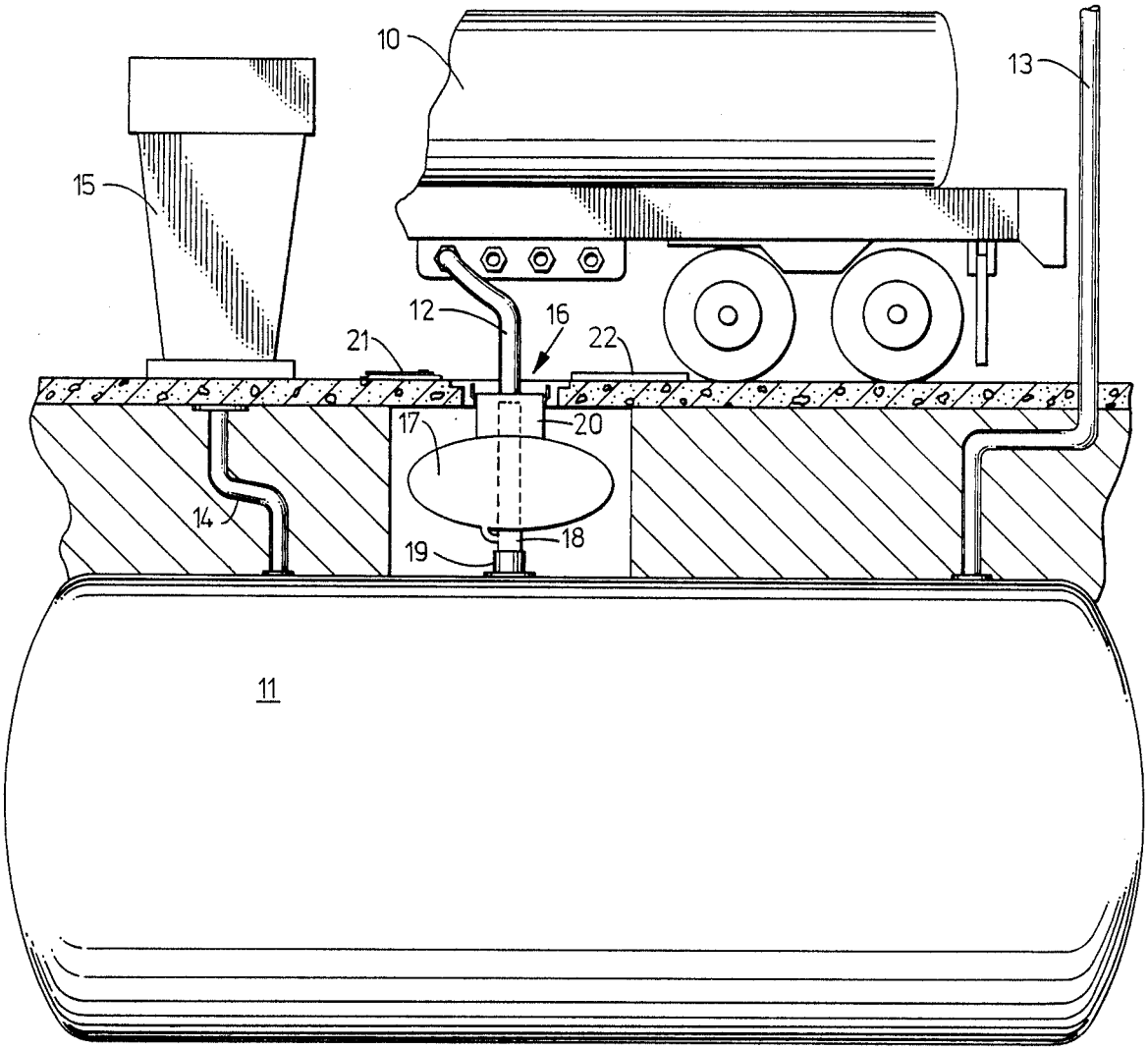
FIG. 1 is a side view of a storage tank with the overfill assembly of this invention being serviced by a tank truck.

Referring to FIG. 1, there is shown a tank truck 10 delivering gasoline to an underground storage tank 11 by means of a flexible hose 12. Gasoline which flows through the hose 12 is controlled by a valve located at a panel on the tank truck adjacent an attachment fitting for the hose. The storage tank 11 is provided with a vent pipe 13 and a delivery line 14 which extends to a service station pump 15. Conventional underground storage tanks have a fill pipe which extends from the storage tank to ground level. An access pit with a surface cover is provided so that removal of the cover will allow ready access to the fill pipe. A cap covers the fill pipe's extremity to keep debris out.

The assembly of the present invention shown generally as 16 receives delivery hose from the tank truck when the storage tank 11 is to be filled. The assembly 16 comprises a dump tank 17 with a vertically mounted fill pipe 18 which extends centrally through the bottom of the dump tank 17 and is threadably attached to pipe nipple 19. A neck 20 extending from the main body of the dump tank 17 is considered a part of the dump tank. A lid member 21 shown removed and laying on the ground allows access to the interior of the dump tank. A removable surface manhole lid 22, preferably watertight, shown laying on the ground provides access to the assembly 16.

Figure 2:
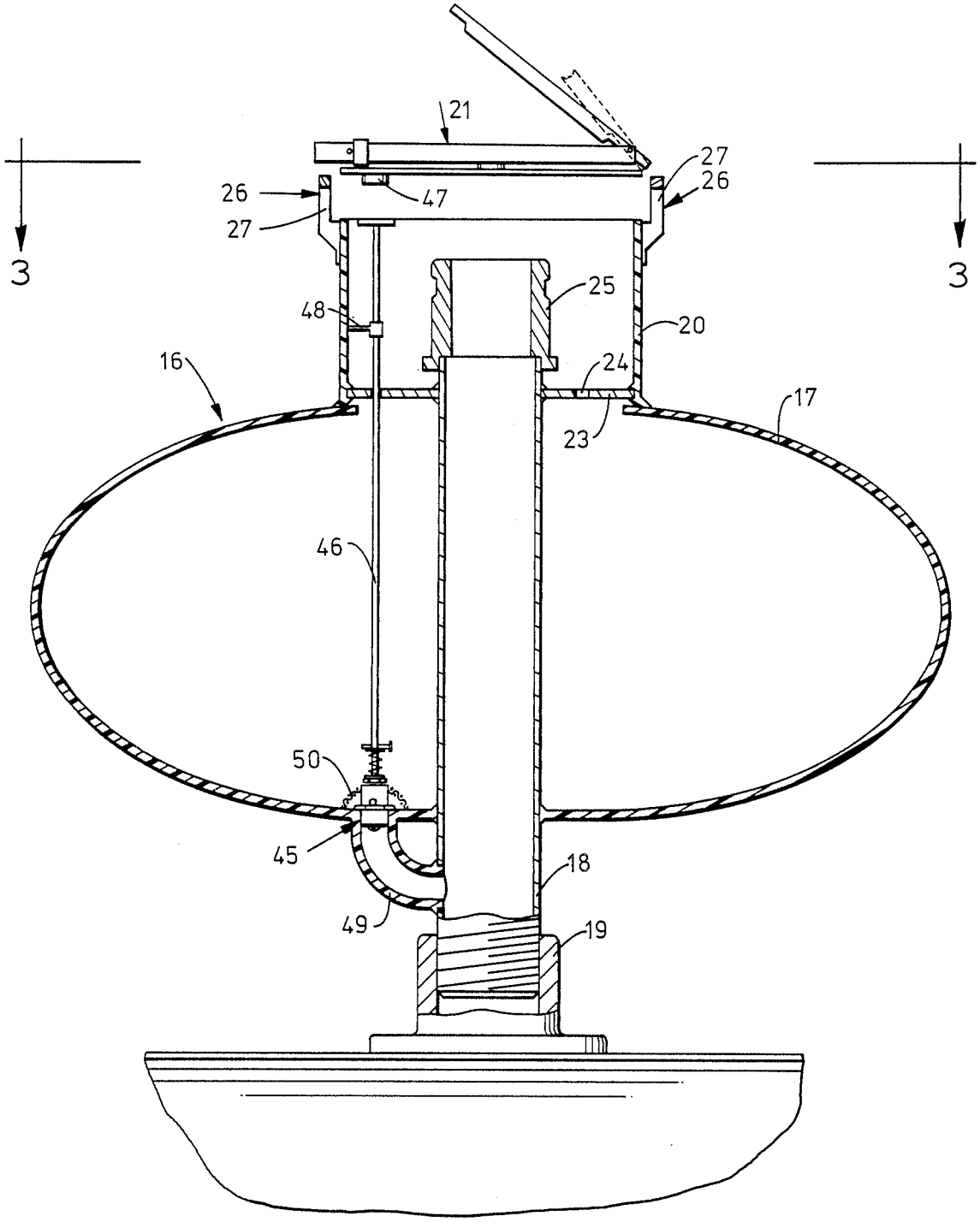
FIG. 2 is a side view in section of the overfill assembly of FIG. 1 with a lid member positioned directly above a top opening.

Shown in detail in FIG. 2, the dump tank 17 has a suitable volumetric capacity of at least about five gallons. About twenty to about fifty-five gallons is a preferred capacity with about twenty to about forty gallons being most preferred. The upper portion of the pipe 18 is centered within the neck 20 of tank 17 by use of attachment plate means 23 radiating from near the frst extremity of the fill pipe to the interior neck walls. Openings 24 are in the plate means 23 to allow spilled gasoline to flow therethrough. The neck's preferred diameter size ranges from about nine inches to about fifteen inches, preferably about twelve inches. The neck's length is about four to about ten inches, preferably about six inches long. An attachment fitting 25 threaded to the end of fill pipe 18 is for the purpose of receiving the delivery hose and provides a liquid tight sealed connection therewith. If desired a cap is also provided for covering the fitting 25.

Figure 3:
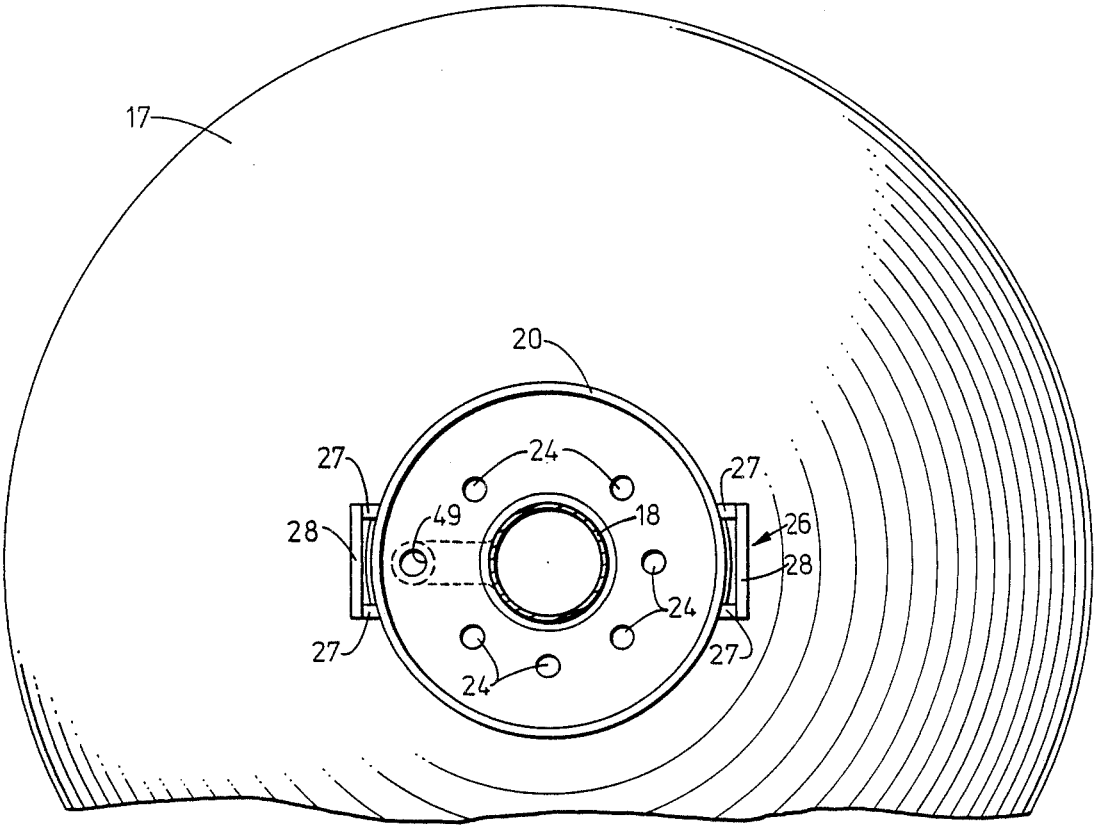
FIG. 3 is a top view of the overfill assembly of FIG. 2 with the lid member removed.
Figure 4:
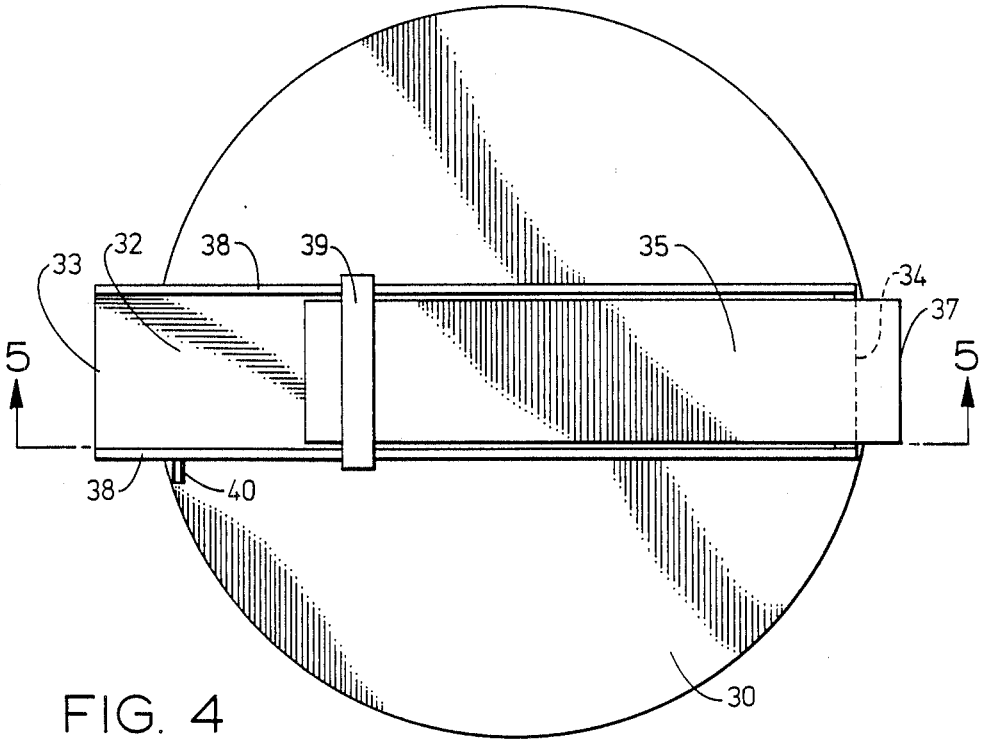
FIG. 4 is a top view of the center-point compression lid member found on the overfill assembly of FIG. 2.
Figure 5:
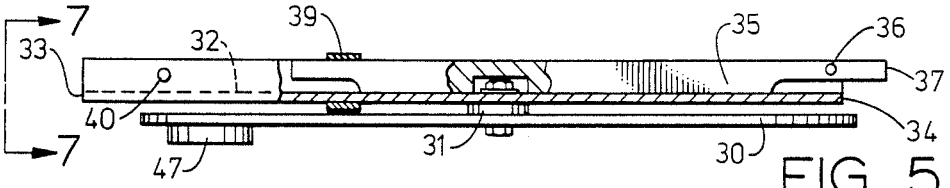
FIG. 5 is a side view in section of the lid member of FIG. 4 taken along line 5—5.
Figure 6:
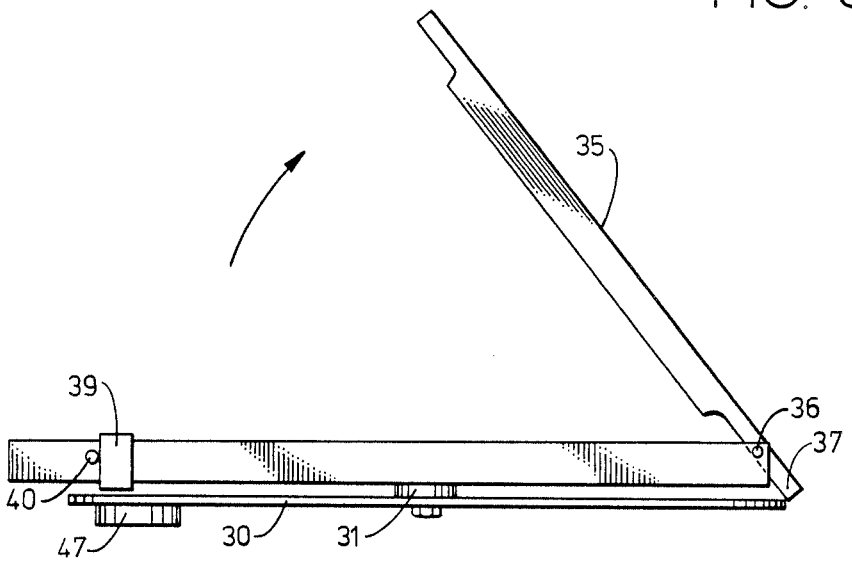
FIG. 6 is a side view of the lid member of FIG. 4 with its lever bar raised.
Figure 7:
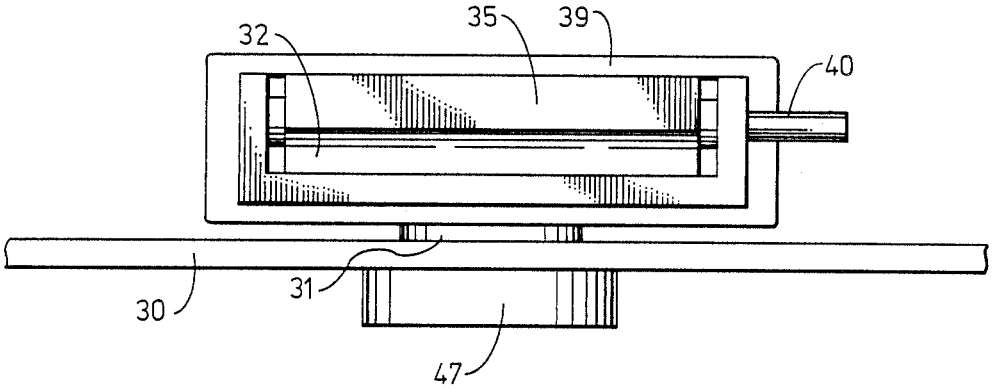
FIG. 7 is a partial end view of the lid member of FIG. 4.

The neck 20 has retaining means 26 for accomodating sealing removable lid member 21. As best seen in FIG. 3, the retaining means is a set of brackets 27 extending from the neck opposite one another. The brackets are attached by bolts or other suitable means to the neck. A retainer cross-pin 28 extends across the brackets and is for the purpose of receiving the lid member. In accord with this invention, a removable center-point compression lid member is used. The lid member is removable so as to aid in a filling operation. That is, a delivery hose from the tank truck can readily gain access to the fil pipe 18 from any direction without being blocked by a hinged lid protruding above ground level. Complete removal of the lid member allows the tank truck operator to set it aside during his fill operation. This allows a smaller ground level access pit to be used than with a hinged lid assembly. This is particularly true with a round access pit. A problem of having to have a hinged lid aligned with a side of a square access pit to maintain a reasonably sized opening is also avoided. At the same time, the excellent sealing qualities of a center point compression lid member are retained.

FIGS. 4–7 show in detail the lid member 21 of FIG.2. Cover 30 is dimensioned to fit over the opening at the dump tank's neck. The cover has a center point spacer 31 attached in the approximate center of the cover. A force transfer bar 32 is attached to the spacer 31. The force transfer bar extends substantially across and through the middle of cover 30. One end 33 of the force transfer bar extends over an edge of the cover. A second end 34, extending to near an opposite edge of cover 30, has a lever bar 35 hingably attached to it by pin 36. The lever bar pivots about pin 36 to either exert or release a force when the lid member is in use. One end 37 of the lever bar extends past an edge of the cover 30. When lever bar 35 is forced downwardly during use, it preferably becomes flush with the force transfer bar 32. Ridges 38 on each side of the force transfer bar in effect provide a recessed inner area in which lever bar 35 fits. A latching means is provided to hold lever bar 35 in place. As shown, a sliding ring 39 positioned on the force transfer bar is capable of sliding towards end 33 to allow lever bar to drop into place, at which time sliding the ring back to cover the lever bar holds it in place. A protrusion 40 extending from the force transfer bar ensures that the ring will not slide off the transfer bar.

To seal off the dump tank's interior from ground water or retain vapors inside, the removable lid member of FIGS. 4–7 is positioned over the tank's opening depicted in FIGS. 2 and 3 and is closed by first placing end 33 of force transfer bar 32 under a retainer pin 28 at about a forty-five degree angle with lever bar 35 raised preferably ninety degrees perpendicular to cover 30. Once cover 30 is lowered and approximately horizontal, the lever bar 35 is pushed down towards the force transfer bar 32 resulting in end 37 of the lever bar being forced under a second retainer pin 27. After the lever bar is pushed down flush with force transfer bar the sliding ring 39 is slid over the lever bar. When the lever bar 35 is in the closed position down upon force transfer bar 32, the spacer 31 is forced downward thereby forcing the cover 30 downward. The outer edge of cover 30 is forced down evenly on the top edges of the dump tank's neck. The cover is deflected into a concave structure formed by center point pressure of spacer 31 and effectively forms a tightly sealed enclosure.

With reference to FIG. 2, a valve 45 in the bottom of the dump tank is activated into an open position by pushing rod 46 downwardly. A striker plate 47 on the underside of the cover 30, optionally provided, is aligned with rod 46 to force the rod down when the lid member is closed. A retaining guide 48 is used to maintain alignment with striker plate 47 and acts as a guide for rod 46. At the bottom of rod 46 there is a mechanical relief valve 45 to allow product dumped into tank 17 to be drained back through a conduit 49 to fill pipe 18 which is in communication with storage tank 11. A screen 50 is provided around the valve assembly at the bottom of the push rod.

Figure 8:
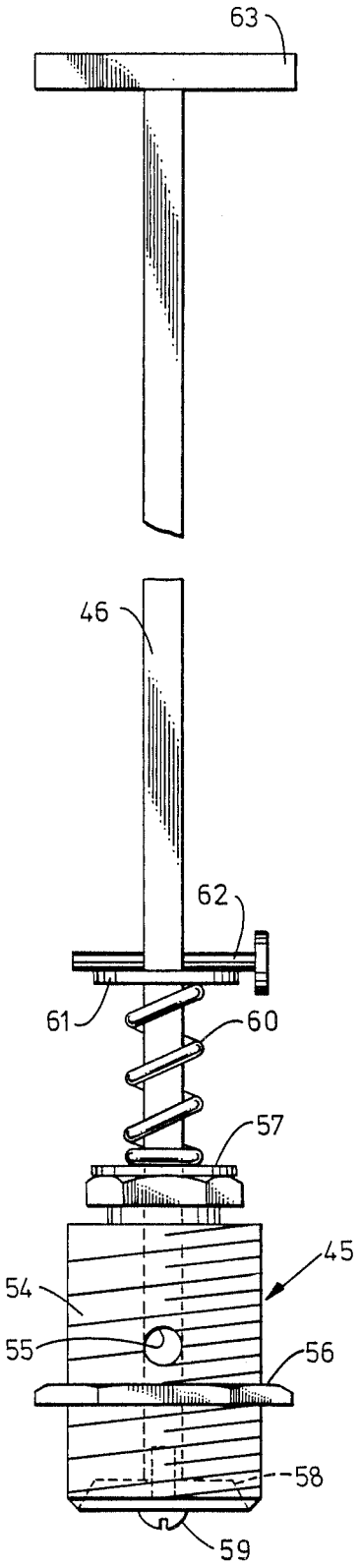
FIG. 8 is a view showing a valve mechanism used in the overfill assembly of FIG. 2.
Figure 9:
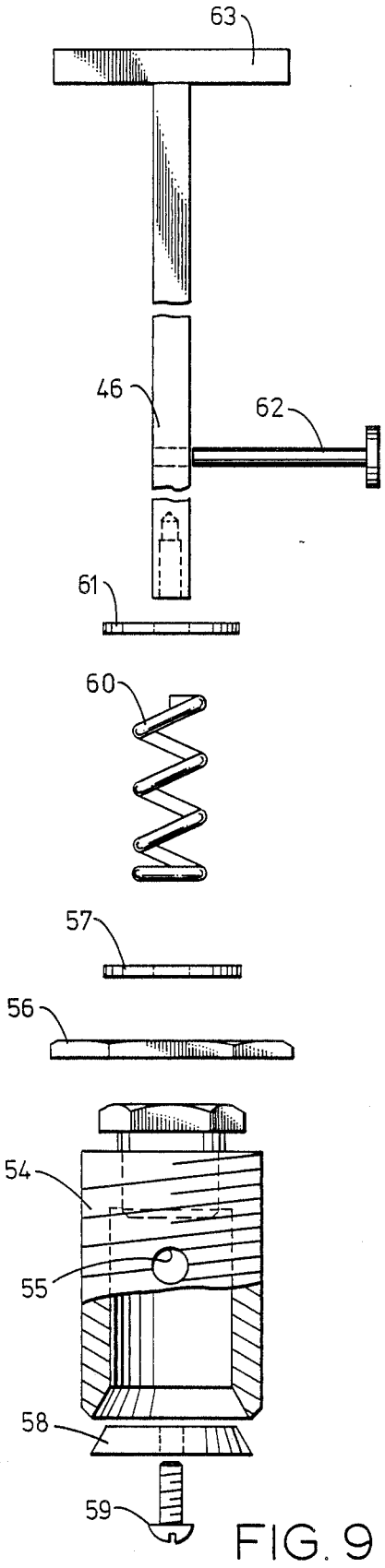
FIG. 9 is an exploded view of the valve mechanism of FIG. 8.

FIGS. 8 and 9 show in detail the valve mechanism of FIG. 2. Hollow fitting 54 threads into the opening at the bottom of the dump tank 17. Holes 55 are spaced around the fitting to be in communication wtih the hollow interior of the fitting. A retaining nut 56 is used to lock the fitting into the dump tank bottom opening. The rod 46 extends through a shoulder 57 into the hollow fitting. A washer 58 dimensioned to seat in an opening in the bottom of the fitting is secured to the end of the rod 46 by screw 59. A spring 60 with stop shoulder 61 and stop pin 62 is used to urge the washer 58 to the hollow fitting bottom opening to effect a closing. A handle 63 is provided to manually operate the opening of the valve mechanism. Any spilled gasoline will be retained in the dump tank by the valve mechanism when at rest. However, storage tank space permitting, manually pushing down on the rod's handle 63 will cause the washer 58 to unseat from the hollow housing bottom opening. This will allow gasoline to flow into the hollow fitting through holes 55 and out through the bottom opening normally closed by washer 58. The gasoline will continue to travel through the conduit 49 shown in FIG. 2 and eventually into the underground storage tank.

Figure 10:
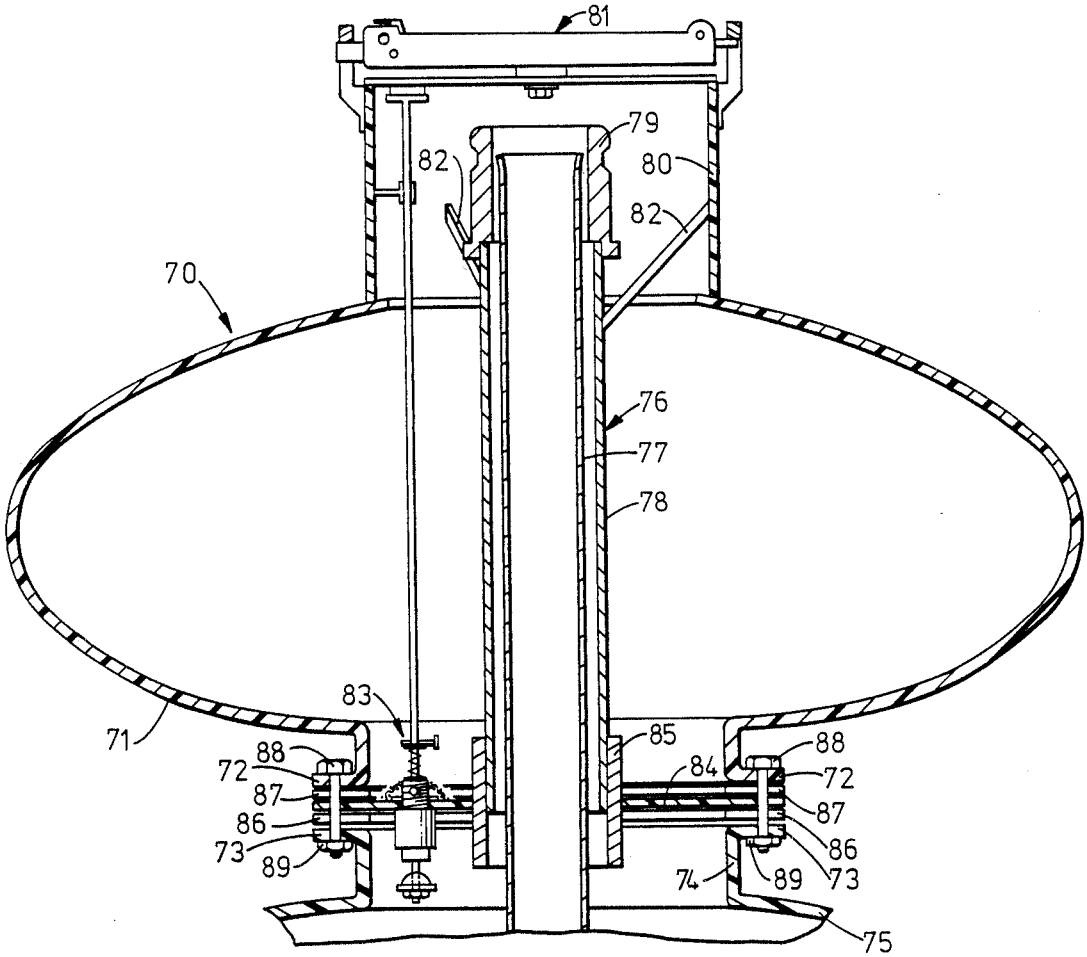
FIG. 10 is a side view in section of another overfill assembly of this invention depicting its mounting to a storage tank's manhead.
Figure 11:
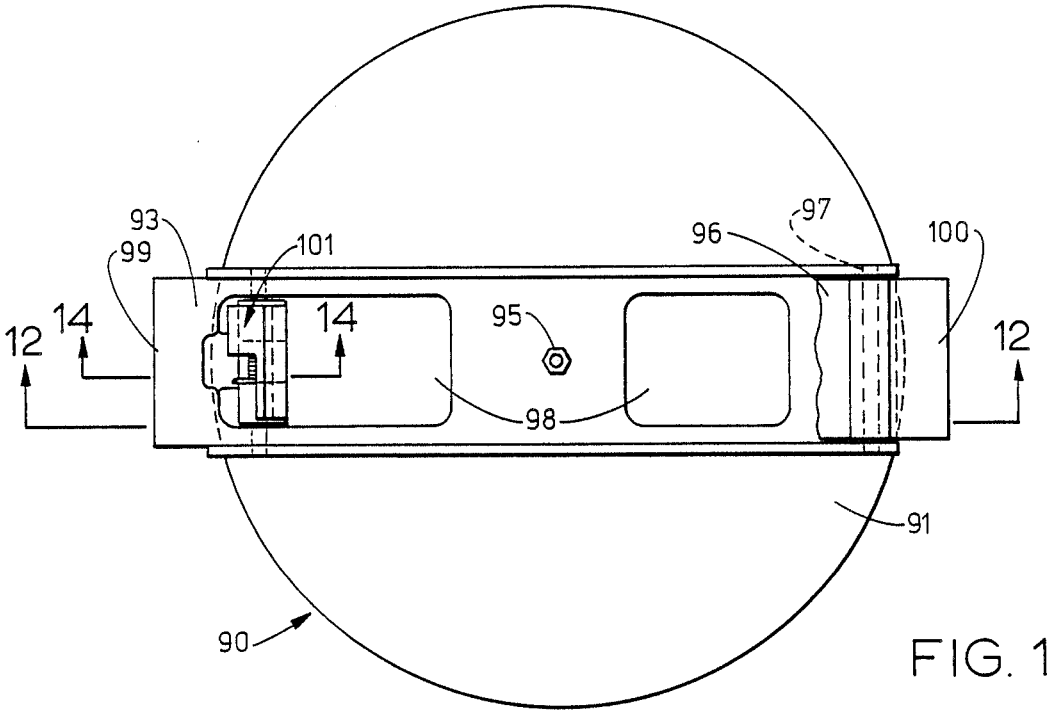
FIG. 11 is a top view of another center-point compression lid member useful with the overfill assembly of the invention.
Figure 12:
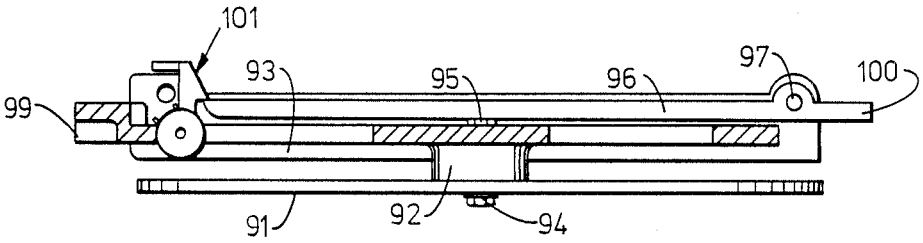
FIG. 12 is a side view in section taken of a lid member along lines 12—12 of FIG. 11.
Figure 13:
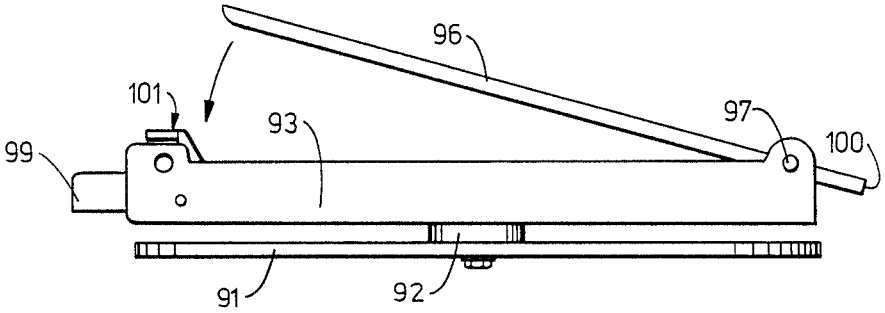
FIG. 13 is a side view of the lid member of FIG. 11.

FIG. 10 shows an overfill assembly 70 for use with a manhead on a storage tank. Certain underground storage tanks have a manway about two to three feet in diameter positioned on the top of the tank. The manway is to allow access by a worker into the tank's interior for purposes of inspection or repair work. A manhead cover is normally bolted to flanges extending from the manway's top surface to seal the storage tank's interior. As shown, dump tank 71 has a flange 72 extending from a bottom extremity. The flange is dimensioned to match with a flange 73 extending from manway 74 on storage tank 75. The bottom surface of the dump tank 71 is substantially flat to sit properly on the manway's flange 73. Fill pipe 76 is comprised of an interior pipe 77 through which liquid gasoline passes during a fill operation and a concentric outer pipe 78 used for vapor recovery. Double walled pipes of this general nature are common. A hose attachment fitting 79 attaches to the top of the fill pipe 76. A neck 80 and a removable center-point compression lid member 81 of the type described with reference to FIG. 2 are also provided. Braces 82 extend from the fill pipe 76 to the neck 80 for the purpose of holding the fill pipe in the approximate center of the dump tank 71.

A valve mechanism 83 is in direct communication with the interior of the storage tank. If desired, the valve mechanism could be in communication with the fill pipe's inner pipe 77. Valve mechanism 83 is of the type described with reference to FIGS. 8 and 9.

The bottom surface of overfill assembly 70 is shown as a bottom plate 84 with a centrally located opening for a fitting 85 to accomodate fill pipe 76. The overfill assembly is installed to the manway 74 by first positioning a gasket 86 on flange 73, placing bottom plate 84 with fill pipe 76 attached thereto on gasket 86, placing gasket 87 over the bottom plate and securing dump tank 70 to the manway flange 73 by bolts 88 and nuts 89.

In an alternate embodiment, bottom plate 84 is an integral part of the dump tank. As such the overfill assembly is complete, ready for installation onto a manway.

Figure 14:
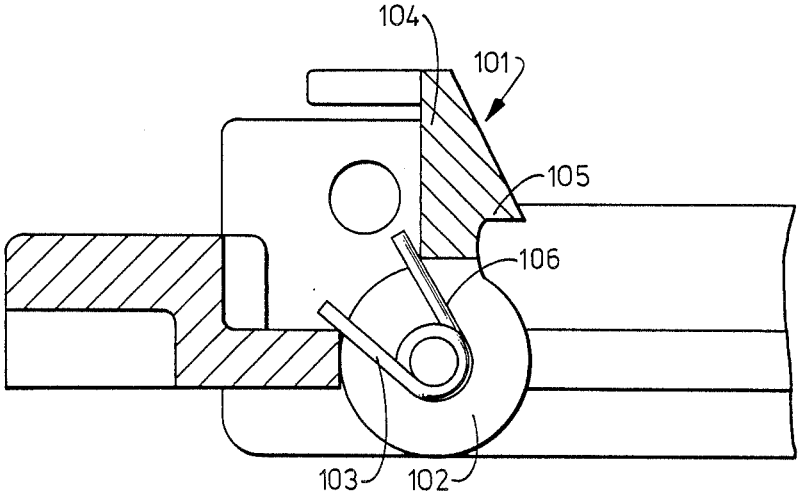
FIG. 14 is a side view in partial section of the lid member taken along lines 14—14 of FIG. 11 showing a latch means.

FIGS. 11–14 show another removable center-point compression lid member. Lid member 90 is similar to that described with reference to FIGS. 3–7. Cover 91 has a center point spacer 92 and a force transfer bar 93 held together by a bolt 94 and nut 95. Lever bar 96 is hingably attched to force transfer bar 93 by pin 97 positioned at one end thereof. Force transfer bar 93 has at least one opening 98 to allow water and debris to pass through and prevent any unwanted build-up on the cover 91. End 99 of the force transfer bar 93 and end 100 of lever bar 96 each extend over the edge of the cover 91 for purposes of fitting under retaining means found on the dump tank. A spring latch 101 is provided on the force transfer bar to receive and hold one extremity of the lever body 96. As best seen in FIG. 14, spring latch 101 has a body 102 which is attached by pin 103 to force transfer bar. The body 102 has a thumb catch 104 which when pushed downwardly causes body 102 to revolve about its pin 103. Lip 105, holding the lever bar, is forced to revolve and release the lever bar. A spring 106 causes the body to return to its rest position when the force is removed from the thumb catch.

Figure 15:
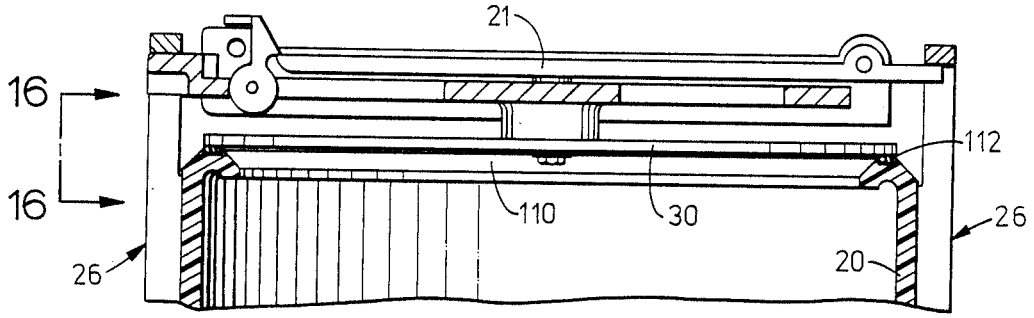
FIG. 15 is a partial view in section showing the use of a gasket and beveled top edge on a dump tank's top opening when a lid member is sealed thereon.
Figure 16:
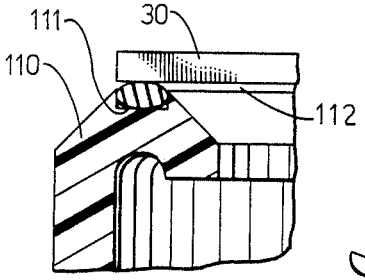
FIG. 16 is a fragmentary view showing a top edge of the dump tank of FIG. 15.
Figure 17:
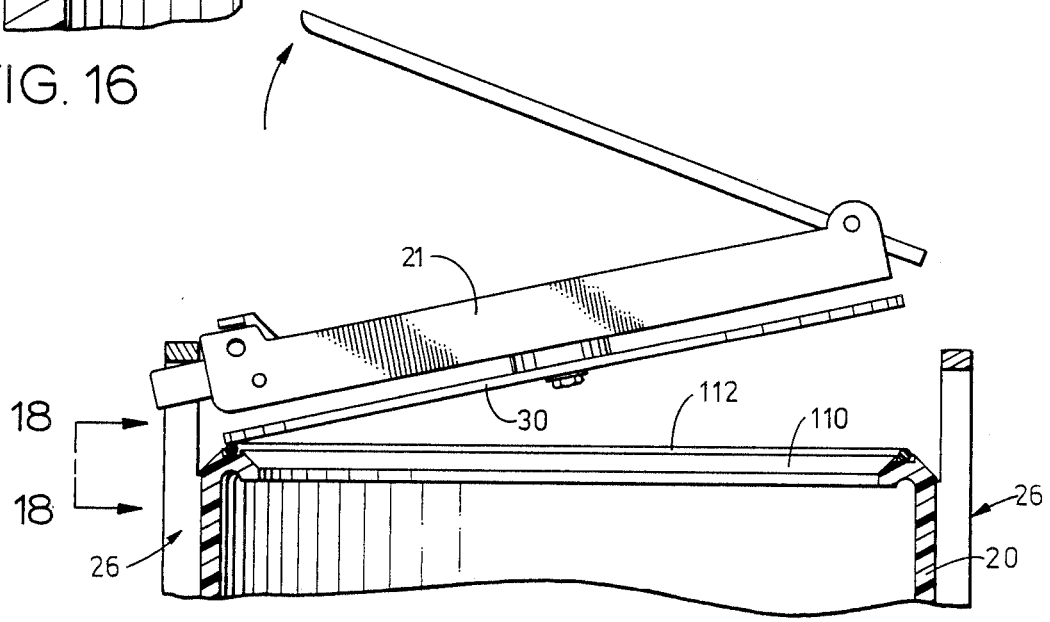
FIG. 17 is a partial view in section showing the dump tank top opening of FIG. 15 when the lid member is under no sealing pressure.
Figure 18:
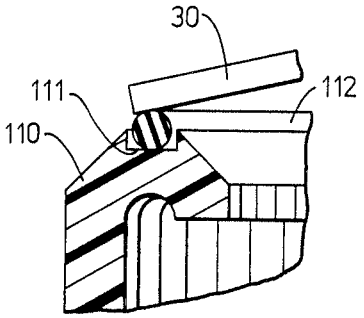
FIG. 18 is a fragmentary view showing a top edge of the dump tank of FIG. 17.

FIGS. 15–18 illustrate a preferred embodiment of the invention. The top edge 110 of the overfill assembly's neck of FIGS. 2 or 10 has a groove 111 to receive an O-ring gasket 112 and is bevelled on both the inside edge and outside edge. The O-ring 112 is an especially effective gasket for sealing the interior of the dump tank. Additionally, it has been found the O-ring serves a secondary advantage of absorbing some of the forces experienced when the lever bar is lowered. Without any kind of gasket material, lowering the lever bar causes the cover to deflect downwardly with a tremendous amount of force at the cover edges. This force, when released by the latch means, causes the lever bar to spring upwardly. The use of an O-ring when steadied by the groove 111 results in the force being absorbed by the O-ring 112 itself and lessen transfer of force through the cover to the lever bar when the latch is released. FIGS. 15 and 16 show the O-ring compressed as a result of pressure applied by the lid member. FIGS. 17 and 18 show the O-ring in a normal state when the lid member has been removed.

The top edge of the neck is bevelled downwardly both towards the outside and the inside of the neck walls. The combination of the O-ring and bevels results in a self-cleaning edge. That is, debris is not likely to remain on the top edge and interfere with obtaining a good seal.

In operation, a tank truck operator first removes the surface manhole lid to expose the overfill assembly of this invention. The center-point compression lid member is removed and placed aside. Next, the delivery hose leading from the tank truck is attached to the fitting on the fill pipe. Gasoline is pumped until the storage tank is substantially filled. The delivery hose is disconnected and gasoline trapped in the hose is released to flow into the dump tank. The valve is opened to allow the gasoline to flow into any remaining head space in the storage tank. If the tank is completely filled, any gasoline still in the dump tank is subsequently drained into the storage tank either by use of an automatic valve or periodic manual operation of the valve. The lid member and manhole cover are replaced when the delivery operation has been completed.

While the overfill assembly has been illustrated and described in detail in the drawings and foregoing description, the same is to be considered as illustrative and not restrictive in character. Various modifications such as the use of relief valves and check valves of all designs can be made valve mechanisms of the type manually operated by pull means can also be used. It is understood that only preferred embodiments have been shown and described and that all changes and modifications that come within the spirit of the invention are desired to be protected.

What is claimed is:

1. An assembly for attachment to an underground liquid storage tank to control overfill of liquid during a filling operation with means to facilitate its use, comprising:

(a) a dump tank having an interior with a volumetric capacity of at least about five gallons, said dump tank characterized in having a main body and a neck extending therefrom with a top opening whereby access is gained to the interior of the dump tank, a bottom opening in the main body to accommodate a fill pipe, a second opening in a bottom of the main body for positioning of a valve mechanism, and permanent retaining means mounting on the dump tank's outside upper surfaces for the purpose of receiving a lid member;

(b) a fill pipe substantially within the dump tank, said fill pipe having a top extremity and a bottom extremity and extending from near the top of the dump tank through the bottom opening of the dump tank;

(c) a plate radiating from near the top extremity of the fill pipe and permanently attached to the fill pipe and interior walls of the neck, said plate having openings for allowing excess liquid to pass therethrough;

(d) a valve mechanism fitted within said second opening in the main body of the dump tank through which overfilled liquid collected in the dump tank can flow; and (e) a completely removable center-point compression sealing lid member for fitting over the top opening of the dump tank so as to form a sealed closing of the dump tank.

2. The assembly of claim 1 further wherein piping leads from the valve mechanism into the fill pipe at a point exterior of the dump tank.

3. The assembly of claim 2 wherein the fill pipe is threaded on its bottom extremity for ready attachment to an underground storage tank fill opening.

4. The assembly of claim 1 wherein the permanent retaining means on the dump tank comprises a first set of brackets mounted on the dump tank and a second set of brackets mounted on an opposite side of the dump tank, with each set of brackets having a retainer cross-pin extending across the brackets and further wherein the lid member comprises:

(i) a cover dimensioned to completely seal the top opening in the dump tank with a center-point spacer permanently positioned in the approximate center of the cover;

(ii) a force transfer bar with a first extremity and a second extremity permanently positioned over the center-point spacer, said force transfer bar having means on its first extremity to engage, when properly aligned, the retainer cross-pin of the first set of brackets found on the dump tank; and (iii) a lever bar with a first extremity and a second extremity pivotably mounted at its second extremity on the force transfer bar's second extremity to engage the retainer cross-pin of the second set of brackets found on the dump tank and said lever bar being sufficiently long enough so that when the lid member is positioned on the dump tank's top opening with the first extremity of the force transfer bar aligned with the retainer cross-pin of the first set of brackets of the dump tank and the second extremity of the lever bar aligned with the retainer cross-pin of the second set of brackets of the dump tank and downward force is exerted on the lever bar, the downward force is transmitted through the center-point spacer to the cover so as to result in substantially equal pressure being exerted by the cover's peripheral edges onto the dump tank's top opening edges to form a liquid-tight tight seal.

5. The assembly of claim 4 further comprising latching means to retain the lever bar in its closed position.

6. The assembly of claim 5 wherein the latching means is a ring slidably positioned on the force transfer bar and dimensioned to hold the lever bar in its closed position when engaged therewith.

7. The asesmbly of claim 6 wherein the valve mechanism is manually operated.

8. The assembly of claim 7 wherein a push means extends from the valve mechanism to a point near the top opening of the dump tank.

9. The assembly of claim 8 wherein the cover has a striker plate positioned on an underside surface so that when aligned with the push means, said push means causes the valve to open.

10. The assembly of claim 1 wherein the dump tank has attachment means for attaching to a manway on the underground liquid storage tank.

11. The assembly of claim 1 wherein the dump tank holds from about twenty gallons to about fifty-five gallons of liquid.

12. The assembly of claim 1 wherein a top edge of the neck has an O-ring groove in said edge's center area and said edge is beveled downwardly on each side.

13. The assembly for attachment to an underground liquid storage tank to control overfill of liquid during a filling operation, comprising:

(a) a dump tank having an interior with a volumetric capacity of at least about five gallons, said dump tank further having a top opening whereby access is gained to the interior of the dump tank, a bottom opening to accommodate a fill pipe, a second opening at a bottom of the dump tank for positioning of a valve mechanism, and permanent retaining means mounted on the dump tank's outside upper surfaces for the purpose of receiving a lid member, said retaining means comprising a first set of brackets mounted on the dump tank and a second set of brackets mounted on an opposite side of the dump tank, with each set of brackets having a retainer cross-pin extending across the brackets;

(b) a fill pipe with a top extremity and a bottom extremity, said fill pipe extending from near the top of the dump tank through the bottom opening of the dump tank;

(c) a valve mechanism fitted within said second opening in the dump tank through which overfilled liquid collected in the dump tank can flow; and (d) a completely removable center-point compression sealing lid member for fitting over the top opening of the dump tank so as to form a sealed closing of the dump tank, said lid member comprising:

(i) a cover dimensioned to completely seal the top opening in the dump tank with a center-point spacer permanently positioned in the approximate center of the cover;

(ii) a force transfer bar with a first extremity and a second extremity permanently positioned over the center-point spacer, said force transfer bar's first extremity engaging, when properly aligned, the retainer cross-pin of the first set of brackets found on the dump tank; and (iii) a lever bar with a first extremity and a second extremity pivotably mounted on the force transfer bar's second extremity to engage the retainer cross-pin of the second set of brackets found on the dump tank and said lever bar being sufficiently long enough so that when the lid member is positioned on the dump tank's top opening with the first extremity of the force transfer bar aligned with the first set of brackets and retainer cross-pin and the second extremity of the lever bar aligned with the second set of brackets and retainer cross-pin and downward force is exerted on the lever bar, the downward force is transmitted through the center-point spacer to the cover so as to result in substantially equal pressure being exerted by the cover's peripheral edges onto the dump tank's top opening edges to form a liquid-tight seal.

14. The assembly of claim 13 further comprising latching means to retain the lever bar in its closed position.

15. The assembly of claim 14 wherein the latching means is a ring slidably positioned on the force transfer bar and dimensioned to hold the lever bar in its clsoed position when engaged therewith.

16. The assembly of claim 15 wherein the valve mechanism is manually operated.

17. The assembly of claim 13 wherein the dump tank holds from about twenty gallons to about fifty-five gallons of liquid.

18. The assembly of claim 13 wherein a top edge of the neck has an O-ring groove in said edge's center area and said edge is beveled downwardly on each side.

* * * * *